US006141974A

United States Patent [19]

Waldmann et al.

[11] Patent Number: 6,141,974

[45] Date of Patent: Nov. 7, 2000

[54] CRYOGENIC AND HEAT PROCESS FOR TREATING SINTERED CARBIDE METALS TO INCREASE SERVICE LIFE

[76] Inventors: Christian Clark Waldmann, 31 Mound St., Milford, Ohio 45150; Fred J. Waldmann, 890 W. Loveland Ave., Loveland, Ohio 45140

[21] Appl. No.: 09/320,606

[22] Filed: May 26, 1999

Related U.S. Application Data

[63] Continuation-in-part of application No. 09/030,526, Feb. 24, 1998, abandoned.

[60] Provisional application No. 60/057,008, Jul. 11, 1997.

[51] Int. Cl.[7] ..... F25D 25/00

[52] U.S. Cl. ..... 62/62; 62/78; 165/2

[58] Field of Search ..... 62/62, 78; 165/2

[56] References Cited

U.S. PATENT DOCUMENTS 4,739,622 4/1988 Smith ..... 62/78

*Primary Examiner*—Ronald Capossela
*Attorney, Agent, or Firm*—Neal O. Willmann

[57] ABSTRACT

This disclosure relates to a process for treating sintered carbide metals, typically cutting tools and parts subject to high abrasive and corrosive wear, to enhance their service life. The process involves exposing the items to be treated to gaseous nitrogen for various periods of time with subsequent elevated heat treatment.

3 Claims, No Drawings

CRYOGENIC AND HEAT PROCESS FOR TREATING SINTERED CARBIDE METALS TO INCREASE SERVICE LIFE

Cross Reference to Related Applications: This application is a continuation-in-part of our application Ser. No. 09/030,526 filed Feb. 24, 1998, now abandoned, which was, in turn, entitled to claim the benefit of U.S. Provisional Application No. 60/057,008 filed Jul. 11, 1997.

BACKGROUND OF THE INVENTION

This invention relates to a process and an associated apparatus for treating sintered carbide metals to improve their structural characteristics at the molecular level. This process is used most advantageously to treat carbide cutting tools and other carbide parts that are, as part of their function, subject to abrasive and corrosive wear and degradation. Tools and parts treated according to the process of this invention demonstrate substantially improved durability and longer tool life than untreated tools and parts.

Sintered carbides are products of powder metallurgy, made of finely divided hard particles of carbide of refractory metal, sintered with one or more metals of the iron group (Fe, Ni, or Co) forming a body of high hardness and compressive strength. Ultimately, most carbide compositions contain basically four components: tungsten carbide, tantalum/niobium carbide, titanium carbide, and cobalt. Each of these is added to give the cutting tool a specific characteristic: strength, toughness, wear resistance at low temperature, chemical wear resistance at high temperature or resistance to deformation at high temperature. Unfortunately, each of these components brings several undesirable properties. And, in an attempt to ameliorate the undesirable properties, cryogenic processes have been developed to improve the durability and service life of all carbide products. To a certain extent, prior art processes have been successful in improving the performance of carbide metal cutting tools; but, as a result of continued experimentation, we have found it beneficial to take additional steps to make an even more durable and serviceable carbide product.

DESCRIPTION OF THE PRIOR ART

U.S. Pat. No. 4,739,622, dated Apr. 26, 1988, to Smith, describes a cryogenic process for treating metallic, carbide, ceramic and plastic parts and items to increase their wear and stabilize their strength characteristics. Unlike the instantly claimed process, Smith teaches partial or substantial submersion of the parts and items in the cryogenic liquid, and Smith never teaches tempering and re-tempering the parts with elevated temperatures.

U.S. Pat. No. 5,259,200, dated Nov. 9, 1993, to Kamody, describes an expedited process for the cryogenic treatment of metal-containing material, preferably in a bath of liquid nitrogen, to improve shockability, wearability, stability and hardness of at least the surface of the article, Like the Smith reference, Kamody does not appreciate the advantages of tempering and, if necessary, re-tempering the treated article at elevated temperatures.

SUMMARY OF THE INVENTION

Notwithstanding the processes of the prior art, and in readily apparent distinction thereto, the process of the present invention relates specifically to a method for treating carbide metals which comprises:

holding a carbide metal item to a sustained temperature of −20° F. to −80° F. for a period of at least 2 hours;

applying gaseous nitrogen to said carbide metal item to lower, at a rate no faster than 3° F. per minute, its temperature to a temperature within the range of −300° F. to −320° F.;

holding said temperature for a period of 2 to 24 hours, depending on the volume and mass of the materials being treated;

elevating the temperature of said carbide metal item to within the range of −80° F. to −20° F. over a 2–4 hour period, depending on the volume and mass of the item being treated;

elevating the temperature of said carbide item to a temperature within the range of 300° F. to 500° F. for a period of about one hour;

reducing the temperature of the carbide item to ambient temperature; and, if necessary, re-heating the item, one or more times, to within the range of 300° F. to 500° F. for a period of about one hour.

DESCRIPTION OF THE PREFERRED EMBODIMENTS

The process of the present invention is specifically for the treatment of various types and grades of carbide metals, typically those used for cutting tools and for use in abrasive and corrosive environments. The process employs, in the treatment of the carbide metal tools, closely controlled temperatures over well-specified periods of time. The temperatures employed, and the periods of exposure, in both the cryogenic and heat tempering cycles, are related to the type, volume and mass of the carbide metal being treated.

In the preferred embodiments of the disclosed invention, the process is carried out in a programmably controlled cryogenic chamber of a size convenient for the items being treated. It may or may not be independently equipped with a refrigerant source. If not equipped, a separate source may be needed to create the −20° F. to −80° F. stabilizing holding temperature used as an initial step in the process. When the items to be treated have reached a stable temperature of −20° F. to −80° F. by means of refrigerant, liquid nitrogen is introduced into the chamber where it is immediately changed into its gaseous form. According to the disclosed process no liquid nitrogen is allowed to come into contact with the items being treated. The temperature of the items being treated is then lowered at a rate no slower than 0.5° per minute, and the measurement of decline is made with resistance temperature detectors (RTDs) or thermocouples.

When the temperature of the items being treated is between −220° F. and −240° F., depending on the mass and volume of the item being treated, it is held at that temperature for a period of time, usually about 1 hour, for temperature stabilization. After a period of stabilization, the temperature is again lowered at its former rate to its lowest level of about −320° F. The items being treated are held at this temperature for 2 to 24 hours and then allowed to warm at no slower rate than 0.50 per minute to the −80° F. to −20° F. temperature level. Again, this rate of "warming" is dependent largely on the mass and volume of the carbide materials being treated.

After this "warming" temperature is reached, he carbide items being treated can be relocated directly to a tempering oven at ambient temperature which is then set to the optimum heat tempering temperature. Heat tempering and re-tempering cycles vary in temperature from 300° F. to 500° F. and vary in the number of cycles from 1–3 depending on the type and grade of carbide being treated. When the heat tempering cycle or cycles are completed, the item is allowed to return to ambient temperature, and it's ready to use.

The increase in the length of service life of the treated carbide item varies with the manner in which it is used. If the treated item is used with the same feed and speed rates as the previously untreated item, the increase in service life can be significant. As an example, one manufacturer using a four cornered carbide insert for machining steel castings was able to machine only 37–40 pieces per corner. After treating the inserts according to the instant process, the same insert cut as many as 746 pieces per corner. Another manufacturer machining aluminum castings using carbide inserts was averaging 2500 parts per insert before treatment. After implementing the disclosed process, that manufacturer was able to machine 19,818 parts Also, any carbide tools that lend themselves to sharpening will need far less stock removal if treated according to the claimed process. This translates into savings of both time and money for tool maintenance.

Specific Examples of the Cryogenic-Heat Treatment Process.

Our first step in the process involves refrigeration of the items to be treated, and that refrigeration step should lower the temperature of the items being treated to between −20° F. to −80° F.; and, in most instances, we lower the temperature of carbide tools to about −40° F. A refrigeration compressor is associated with our cryogenic chamber to maintain this refrigeration temperature. This refrigeration temperature also insures that the carbide items being treated are at the same temperature when gaseous nitrogen is introduced, and the refrigeration temperature reduces the time and the amount of nitrogen necessary for the cryogenic step. Also, the refrigeration temperature serves as a holding temperature after cryogenic treatment and prior to heat tempering. Holding at refrigeration temperature prevents rust and corrosion from forming from the ice that accumulates on the treated items when re-introduced to ambient temperature.

The carbide tipped saw blades to be treated in this instance were placed in the cryogenic chamber and brought to a temperature of −80° F. and held at that temperature until the nitrogen cycle began.

Gaseous nitrogen is introduced into the cryogenic chamber and the temperature of the interior of the chamber and its contents allowed to decrease no faster than 3° per minute. The variables coordinating this gradual descent are the amount of nitrogen and the mass and volume of the carbide items.

The saw blades are maintained at a temperature of −220° F. to −240° F., for up to an hour to stabilize the temperature throughout the parts being treated. Then the descent continues at the previous rate until the −300° F. is reached. The carbide blades were maintained at this temperature for four hours. Then the temperature was raised to between −80° F. to −20° F. and held there until heat tempered.

Heat tempering was initiated by introducing the carbide saw blades to ambient oven temperature and quickly heated to between 350° F. and 375° F. The carbide blades were held at this temperature for one hour. They were returned to near-ambient and then tempered again at 350° F. to 375° F. for another hour. The blades were ready for use upon a final return to ambient temperature.

When treating carbide drills and reamers, we followed the same process protocol set forth above. The rate of temperature descent was decreased to accommodate the thicker material. The duration of cryogenic treatment was up to eight hours. The carbide items were brought back to 40° F. and put into an oven at ambient temperature and tempered three times: at 300° F., then 375° F. and finally at 450° F.

Carbide inserts of various shapes and grades were similarly taken through the cryogenic cycle, but heat tempering varied with the grades of the carbide. Most were tempered with one or more cycles at from 325° F. to 425° F. depending on the grade and type of the carbide treated. For instance, Straight tungsten carbides are tempered at the lower end of the range of the tempering temperatures, and titanium and tantalum carbides are treated at the higher end of the tempering temperature range.

While the foregoing is a complete and detailed description of preferred embodiments of the disclosed process, numerous modifications and variations may also be employed to implement the all-important purpose of the invention without departing from the spirit of the invention; and, therefore, the elaboration provided should not be assumed to limit, in anyway, the scope of the invention which is fairly defined by the appended claims.

What is claimed is:

1. A process for treating carbide metal items which comprises:

holding a carbide metal item at a sustained temperature in the range of −20° F. to −80° F. for a period of at least 2 hours;

applying gaseous nitrogen to said metal to lower, at a rate no faster than 3° F. per minute, its temperature to within the range of −300° F. to −320° F.

holding said temperature for a period of 2 to 24 hours;

elevating the temperature of said carbide item to within the range of −80° F. to −20° F. and holding said temperature for a period of 2–24 hours;

elevating the temperature of said carbide item to within the range of 300° F. to 500° F. for a period of about one hour; and allowing the temperature of the carbide metal item to return to ambient temperature.

2. The process according to claim 1 wherein the carbide item is re-heated to a temperature within the range of 300° F. to 500° F. for a period of about one hour.

3. The process according to claim 1 further including holding the temperature of the item being treated at a temperature in the range of −220° F. to −240° F. for a period of about 1 hour before applying sdditional gaseous nitrogen to further lower the temperature of the item being treated.

* * * * *